United States Patent [19]

Chin

[11] 4,002,341

[45] Jan. 11, 1977

[54] BOARD GAME OF THE HARE AND TORTOISE

[75] Inventor: Kenneth Gan Gee Chin, Elmhurst, N.Y.

[73] Assignee: Lawrence Peska Associates, Inc., New York, N.Y. ; a part interest

[22] Filed: Jan. 23, 1976

[21] Appl. No.: 651,803

[52] U.S. Cl. ..... 273/134 G; 273/134 D; 273/134 B; 273/134 GB; 273/131 K

[51] Int. Cl.[2] ..... A63F 3/00

[58] Field of Search ..... 273/131, 134, 136

[56] References Cited

UNITED STATES PATENTS

| | | | |
|---|---|---|---|
| 1,492,072 | 4/1924 | Cornell et al. | 273/131 K |
| 3,860,241 | 1/1975 | Leftin | 273/134 AE |
| 3,908,998 | 9/1975 | Fong | 273/131 AB |

*Primary Examiner*—Delbert B. Lowe

[57] ABSTRACT

A board game of the hare and tortoise includes a playing board having a top playing surface thereon, wherein the playing surface is divided into playing squares formed from a plurality of intersecting vertical and horizontal lines. Two squares are designated as a start position and two squares are designated as a finish position. A pair of movable playing pieces are moved in a horizontal or vertical direction on the playing surface as determined by the roll of a die. A plurality of obstacle members are movably contained on the board.

6 Claims, 5 Drawing Figures

BOARD GAME OF THE HARE AND TORTOISE

BACKGROUND OF THE INVENTION

A number of U.S. Patents: No. 2,658,760; No. 3,433,483; and No. 3,463,496 have involved movable playing pieces on a playing surface, wherein the movable playing pieces move around a circular or oval shaped route. These aforementioned patents are non-applicable to my present invention, wherein the race between a hare and a tortoise is conducted on a generally rectangular shaped playing surface. The routes from the start to the finish position are not predetermined as in the aforementioned, but are an infinite number of possibilities as determined by the selection of each player.

SUMMARY OF THE INVENTION

My present invention relates to a unique and novel board game involving a race between two playing pieces such as a hare and a tortoise.

An object of my present invention is to provide a board game for a race between two playing pieces, wherein the board game is universally appealing to all age groups.

A further object of my present invention is to provide movable obstacle members on the playing surface which permits a number of variations of the playing surface to be created with relative ease.

Briefly, my present invention comprises a playing board having a top playing surface thereon, wherein the playing surface is divided into playing squares formed from a plurality of intersecting vertical and horizontal lines. Two squares are designated as a start position and two squares are designated as a finish position. A pair of movable playing pieces are moved in a horizontal or vertical direction on the playing surface as determined by the roll of a die. A plurality of obstacle members are movably contained on the board.

BRIEF DESCRIPTION OF THE PREFERRED DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
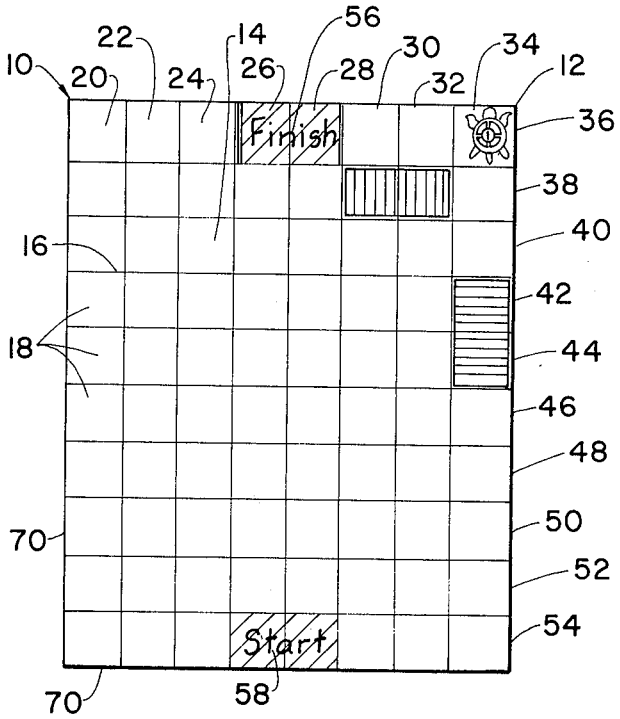
FIG. 1 illustrates a top view of a playing board of a board game.
Figure 2:
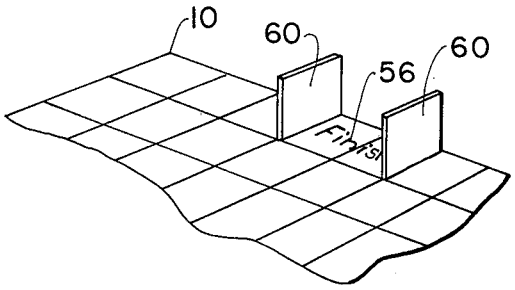
FIG. 2 illustrates a perspective view of a section of the playing board.

Turning now descriptively to the drawings, in which similar reference characters denote similar elements throughout the several views, FIGS. 1–2 show a playing board 10 of a board game of the hare and tortoise. The playing board 10 comprises a rectangular shaped member 12 having a top playing surface 14. A grid system 16 of a plurality of playing squares 18 is contained on the top playing surface 14. The grid system 16 is formed from eight vertical rows 20, 22, 24, 26, 28, 30, 32, 34, intersecting 10 horizontal rows 36, 38, 40, 42, 44, 46, 48, 50, 52, 54. The two playing squares 36-26, 36-28 are designated as the finish position 56 on the playing board 10. The two playing squares 54-26, 54-28 are designated as the start position 58 on the playing board 10. A vertical board 60 extends upwardly from the top playing surface 14 from the junctures between playing squares; 36-24 and 36-26; 36-28 and 36-30; 54-24 and 54-26; and 54-28 and 54-30.

Figure 3:
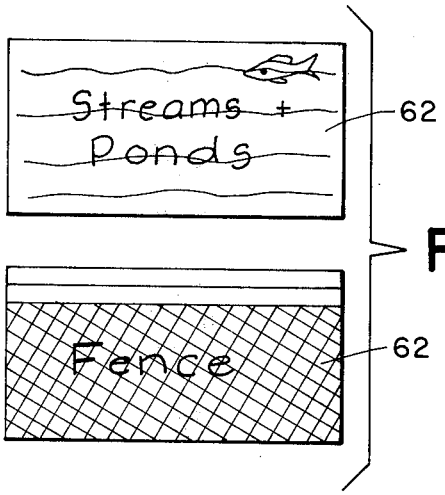
FIG. 3 illustrates a top view of obstacle members that are positioned on the playing board.

As shown in FIGS. 1 and 3 a plurality of obstacle members 62 are positioned on the top playing surface 14, such as streams, ponds and fences. Each obstacle member 62 occupies two playing squares 18, wherein members 62 cannot be positioned directly in front of the finish 56 and start 58 positions.

Figure 4:
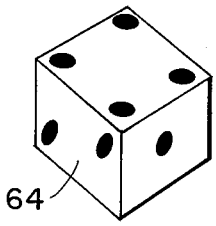
FIG. 4 shows a perspective view of a die.

As shown in FIG. 4, a die 64 is provided for determining the number of playing squares 18 a player moves in a horizontal or vertical direction on the playing surface 14.

Figure 5:
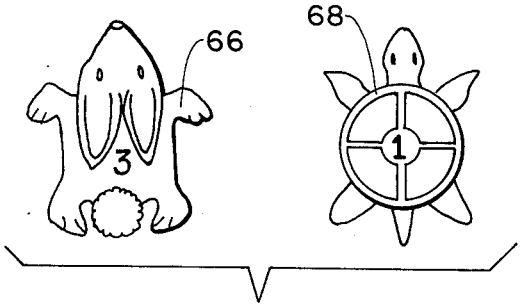
FIG. 5 shows a top view of the playing pieces of the board game.

As shown in FIG. 5, the two playing pieces 66, 68 moved on the top playing surface 14 are formed in the shape of a hare and a tortoise.

The game is played as follows by two players:

Each player rolls the die 64 to determine which player moves first, wherein the play alternates back and forth between the two players. Each player places his playing piece 66, 68 in the start position 58. The objective of the game is to move the playing pieces 66, 68 into the finish position 56. Each playing piece 66, 68 can move a number of playing squares 18 in a horizontal or vertical direction on the playing surface 14 corresponding to the number rolled on the die 64. If a player during his move engages the peripheral border 70 or one of the vertical boards 60, the player must reverse his direction of movement for the number of squares remaining in his move. For example, the player is on square 50-28 and the die 64 indicates to move five squares. The player may choose to move to the right in a horizontal direction to square 50-34 then back to the left in a horizontal direction to square 50-30. In order to enter the finish position 56, the player must move the total number indicated on the die 64. For example, the player is on square 42-26, he must roll a three on the die 64. If the player had rolled a four, five or six on the die 64, he would not be able to enter the finish position 56. If hare playing piece 66 lands on or crosses a stream or pond obstacle 62, the player loses his next turn. If the tortoise playing piece 68 lands on or crosses a fence obstacle 62, the player loses his next turn.

A story book of the hare and the tortoise by the author, Aesop, is provided with the board game.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A board game, which comprises:

a. a playing board having a top playing surface thereon, said top playing surface subdivided into a plurality of playing squares;

b. two of said playing squares being a start position;

c. two of said playing squares being a finish position;

d. vertical boards extending upwardly from each side of said finish and said start positions;

e. two movable playing pieces movable on said playing squares;

f. a plurality of obstacle members movably contained on said playing surface, each said obstacle member occupying two said playing squares; and g. a die for indicating the number of said playing squares to move each said movable playing piece.

2. A game according to claim 1, wherein said two movable pieces are formed in the shapes of a hare and a tortoise.

3. A game according to claim 2, wherein there are 80 playing squares.

4. A game according to claim 3, wherein said obstacle members are streams, ponds, and fences.

5. A game according to claim 1, wherein there are eight vertical rows intersecting ten horizontal rows to form said playing surface.

6. A game according to claim 1, wherein said movable playing pieces are moved in a horizontal or vertical direction on said playing surface.

* * * * *